US005218775A

United States Patent [19]

Singer

[11] Patent Number: 5,218,775

[45] Date of Patent: Jun. 15, 1993

[54] DISPLAY ADAPTER FOR SIGNBOARD

[76] Inventor: Jacques J. Singer, 287, de la Clairière, Rosemère, Quebec, Canada, J7A 3Z2

[21] Appl. No.: 802,866

[22] Filed: Dec. 6, 1991

[30] Foreign Application Priority Data

Jan. 21, 1991 [GB] United Kingdom ..... 9101322

[51] Int. Cl.[5] ..... G09F 7/22

[52] U.S. Cl. ..... 40/617; 40/612; 40/605

[58] Field of Search ..... 40/486, 584, 611, 492, 40/617, 605, 612; 248/692

[56] References Cited

U.S. PATENT DOCUMENTS

| | | | |
|---|---|---|---|
| 1,843,818 | 2/1932 | Isenhour | 40/617 |
| 1,866,554 | 7/1932 | Fairbanks | 40/617 |
| 2,021,083 | 11/1935 | Novak | 40/492 |
| 2,032,561 | 3/1936 | Buehler | 40/617 |
| 2,345,913 | 4/1944 | Bishop | 40/606 |
| 4,318,238 | 3/1982 | Macarle, Jr. | 40/486 X |
| 4,706,400 | 11/1987 | Howard et al. | 40/617 |

*Primary Examiner*—Kenneth J. Dorner
*Assistant Examiner*—Milton Nelson, Jr.
*Attorney, Agent, or Firm*—Roland L. Morneau

[57] ABSTRACT

A display device hooked to a signboard comprises a placard and a connecting member fixed to the signboard for hooking the placard which is provided with a L-shaped slot extending from the upper edge of the placard. The connecting member is characterized by a forwardly projecting stem adjacent one edge and an abutment member forwardly projecting from the signboard and located below the stem and further remote from the lateral edge which is adjacent the stem. The L-shape slot in the placard is adapted to engage the stem while the placard is in a tilted position and the abutment member is adapted to abut on the above-mentioned edge when the placard is pivoted in a vertical position.

7 Claims, 8 Drawing Sheets

DISPLAY ADAPTER FOR SIGNBOARD

BACKGROUND OF THE INVENTION

1. Field of the Invention

The invention relates to a placard adapted to be hooked to a fixed signboard. The signboard is modified by the addition of a connecting member comprising a pair of spaced protuberances on its surface and a retaining plate fixed to each protuberance. The placard which has an L-shaped slot through its upper edge is adapted to hook onto one protuberance and abut against the other.

2. Prior Art

A search of the prior art has revealed two United States patents related to display signs.

U.S. Pat. No. 2,032,561 relates to an advertising display sign of the knock-down variety adapted to be suspended from a wall or other vertical supporting surface. The display sign includes a wing portion which extends perpendicularly from wall and a sign card suspended therefrom by a pair of ears 6 extending through the slots 30. The two ears stabilizes the card 5.

In U.S. Pat. No. 2,345,913, display card is mounted between two hollow tubular column members. The display card has an L-shaped slot which extends on its lateral edge on both sides of the display card. Such an arrangement allows the card to be evenly suspended from both sides. The rivets from which the display card is suspended are sufficient to support the card without the use of any additional abutment to maintain the card vertical direction.

SUMMARY OF THE INVENTION

The display device according to the invention includes a placard adapted to be releasably suspended from and adjacent a fixed signboard by means of a connecting member. The connecting member includes a stem forwardly projecting from the signboard adjacent one edge thereof and an abutment member forwardly projecting from the signboard and located below the stem and further remote from the lateral edge than the stem. The placard has an L-shaped slot extending through its upper edge and adjacent the above mentioned lateral edge. The slot is shaped by a pair of channels, one of which extends downwardly from the upper edge and a second channel extends from the first channel to an area in the direction of the above mentioned lateral edge of the placard. The distance between the above mentioned area and the lateral edge of the placard corresponds substantially to the horizontal distance between the stem and the abutment member. In operation, when the L-shaped slot is hooked on the stem, the lateral edge of the placard rests against the abutment member in a substantially vertical direction and in the same plane as the plane of the signboard.

The stem and the abutment member are preferably connected together by a retaining plate substantially parallel to the signboard and at a distance slightly greater than the thickness of the placard for allowing the portion of the placard adjacent the above mentioned area to slide between said plate and said placard.

DETAILED DESCRIPTION OF THE INVENTION

Figure 1:
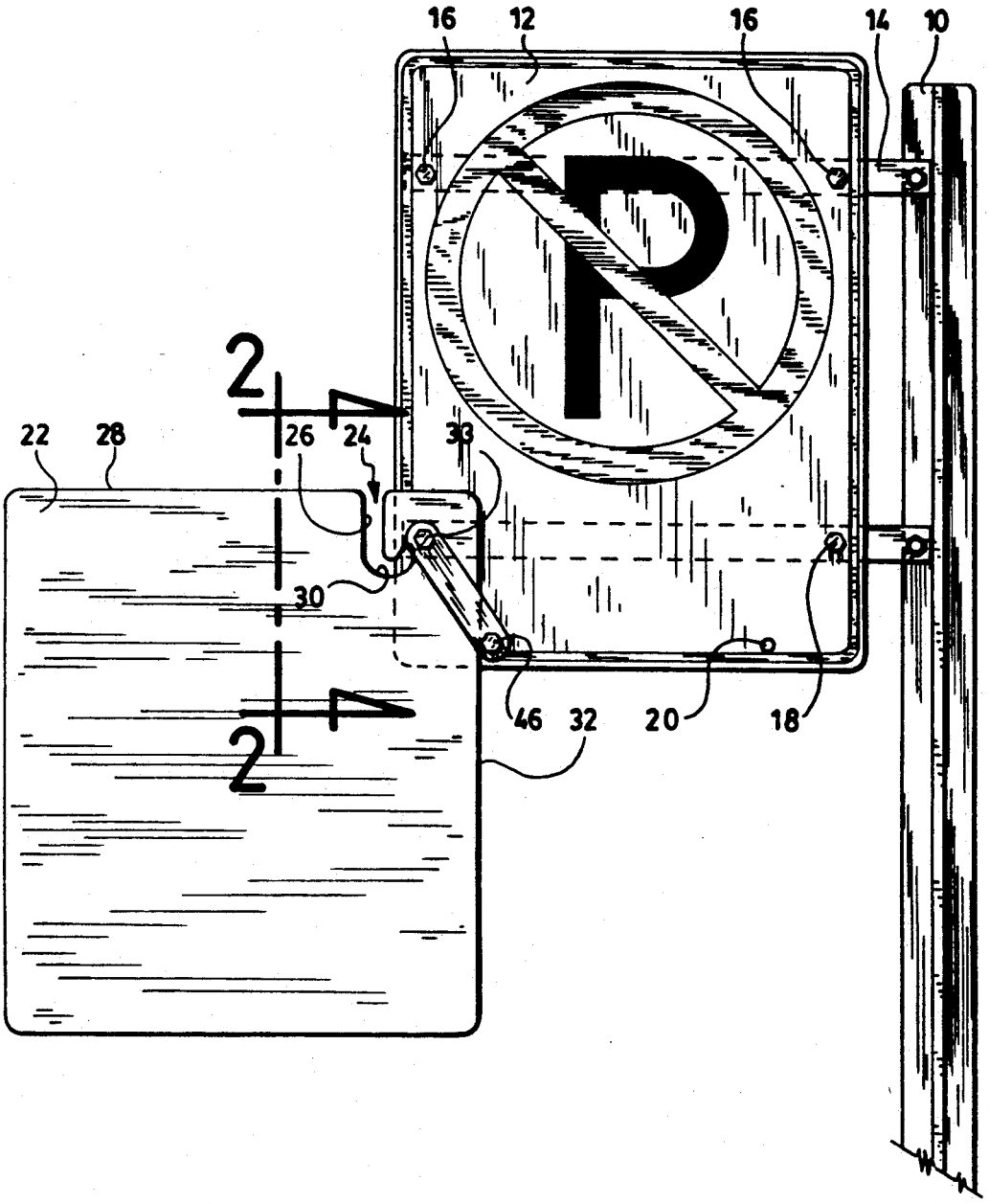
FIG. 1 is a front view of a placard according to the invention supported by a signboard.
Figure 2:
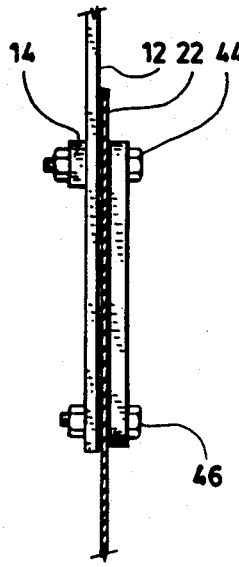
FIG. 2 is a side view of the hooking arrangement of the placard to the signboard along line 2—2 of FIG. 1.
Figure 3:
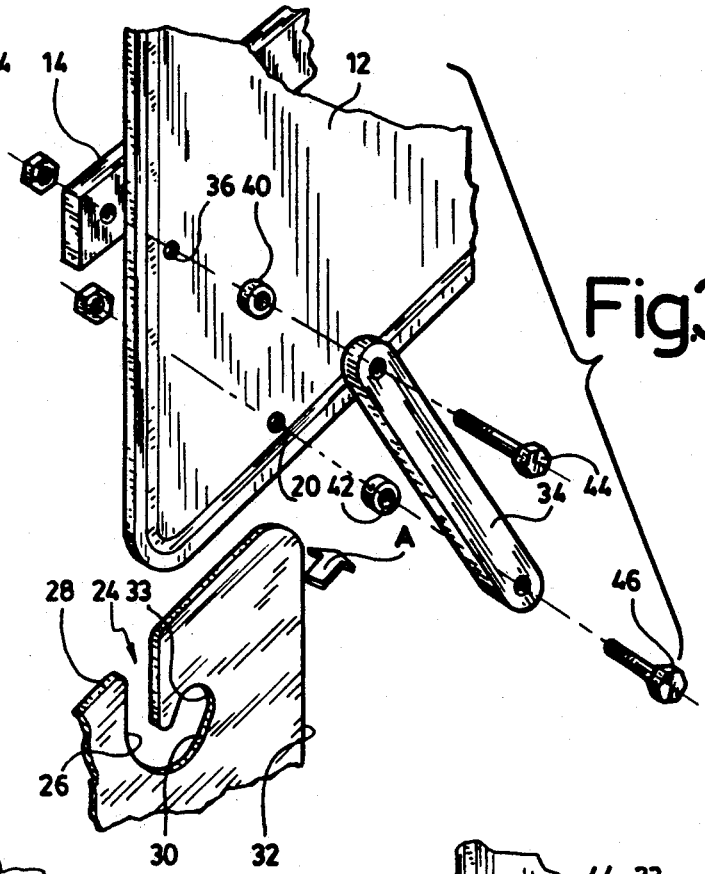
FIG. 3 is an exploded view of the hooking arrangement shown in FIG. 2, FIGS. 4 and 4*a* are two different positions of the placard during its installation on the signboard.

FIG. 1 illustrates a post 10 supporting a signboard 12 commonly known as a no parking sign. Such a signboard 12 is usually rigidly secured to the post by means such as brackets 14 with bolts and nuts such as 16 and 18 passing through holes already provided in the signboard 12. The signboard has also a pair of holes 20 located adjacent the lower edge of the signboard 12. The signboard 12 is used to hook a placard 22 which is intended to carry temporary information such as daily or weekly information. The placard 22 is provided with a generally L-shaped slot 24 having one channel 26 extending downwardly from the upper edge 28 and a second channel 30 extending in the direction of a lateral edge 32 up to a locus or area 33.

A retaining plate 34 is supported by the signboard 12 through holes 20 and 36 which are commonly provided in such signboards. The retaining plate 34 is spaced from the signboard 12 by a stem 40 and an abutment member 42 and retained to the signboard 12 by bolts 44 and 46. The thickness of the stem 40 and the abutment member 42 are equal or slightly greater than the thickness of the placard 22 for allowing the latter to be inserted in the direction of the arrow A between the signboard and the retaining plate 24.

Figure 4:
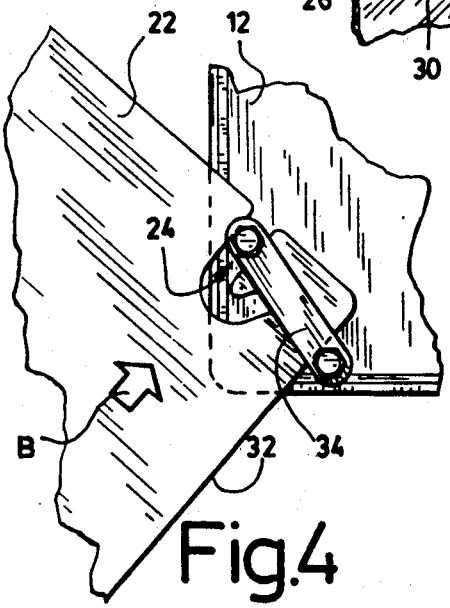
Figure 4A:
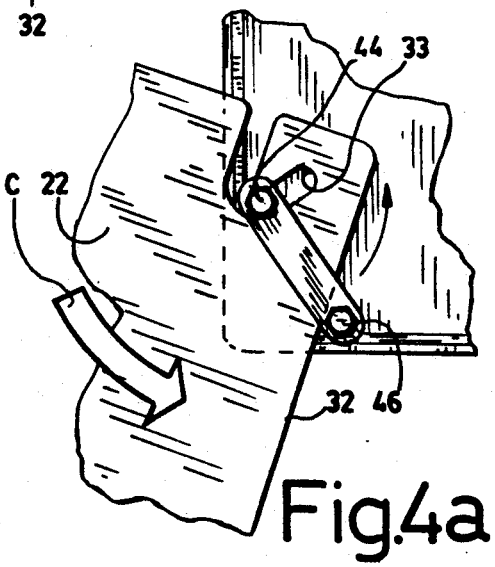

As illustrated in FIGS. 4 and 4*a*, the placard 22 is pushed in the direction of the arrow B for the insertion of the stem 42 in the channel 26 until the stem reaches the channel 30. Then, the placard 22 is pivoted in the direction of the arrow C to allow the stem 42 to penetrate up to the area or locus 33. At that stage, the placard 22 has reached its upright position and that lateral edge 32 is spaced from the area 33 so as to abut against the abutment member 42 supported by the bolt 46. For this purpose, the horizontal distance between the locus 33 and the lateral edge 32 corresponds to the horizontal distance between the stem 40 and the abutment member 42. In the final installed position of the placard, the latter reaches the position illustrated in FIG. 1.

Figure 5:
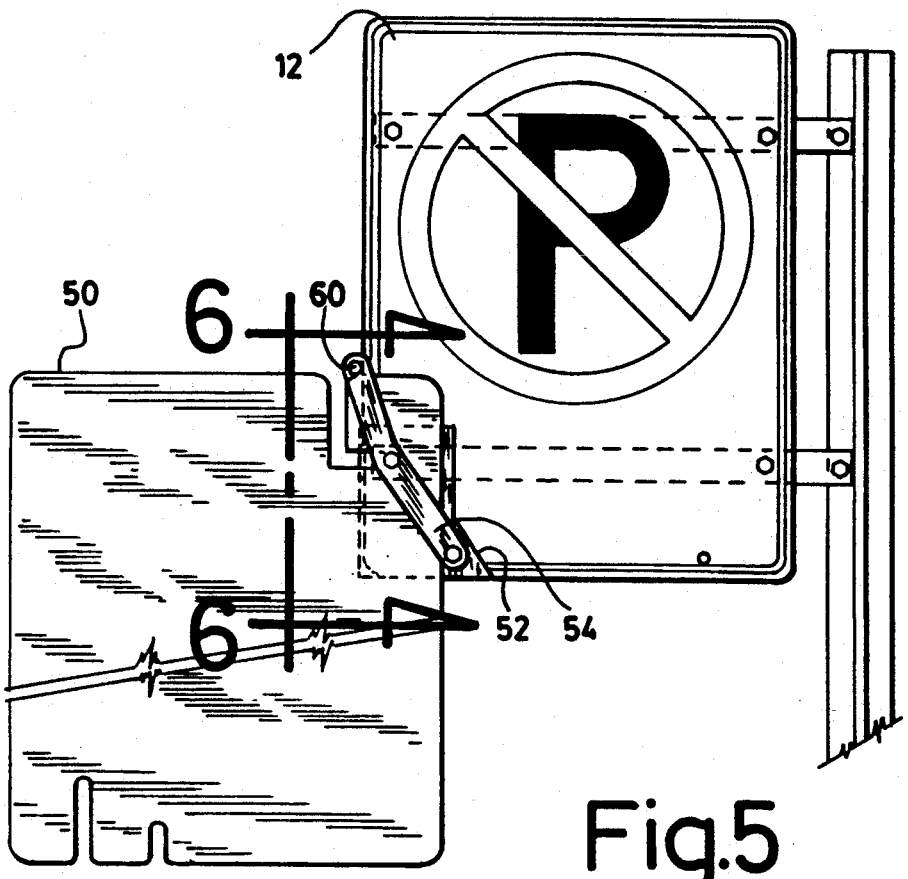
FIGS. 5 and 5*a* are two alternative embodiments of the invention including a panel secured to the signboard.
Figure 5A:
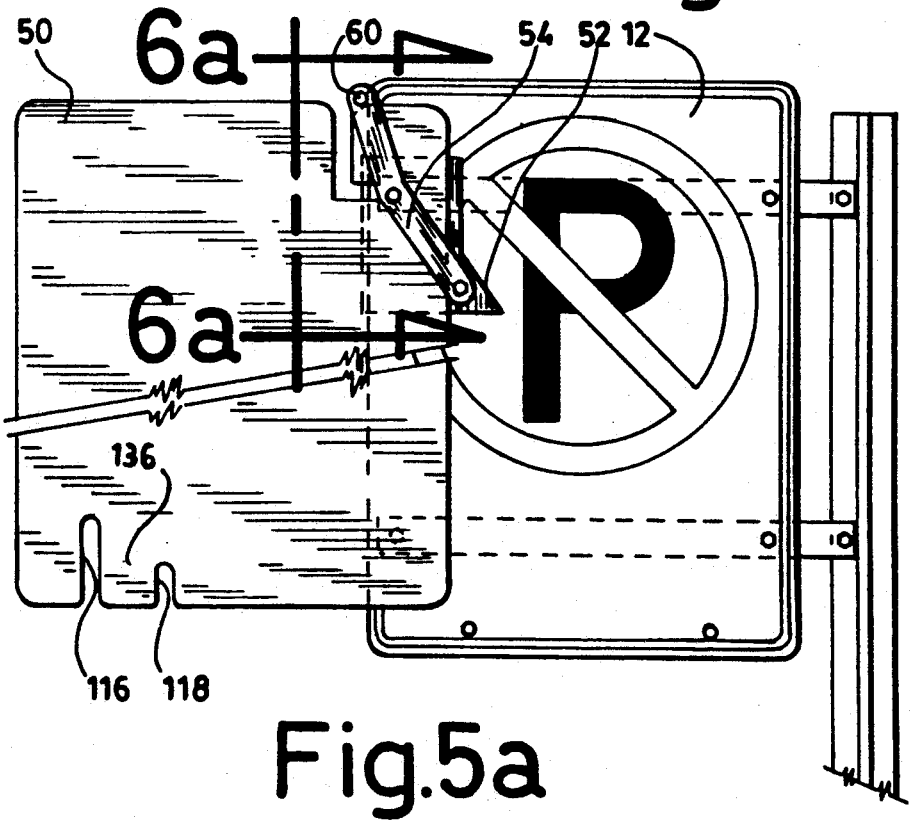
Figure 6:
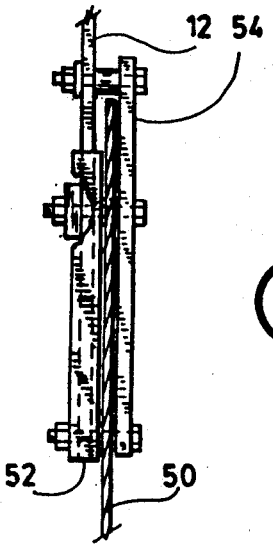
FIGS. 6 and 6*a* are two side views taken along lines 6—6 and 6*a*—6*a* of FIGS. 5 and 5*a*.
Figure 6A:
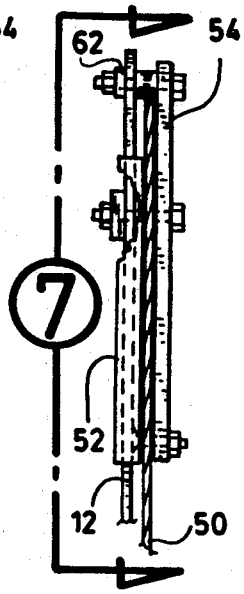
Figure 7:
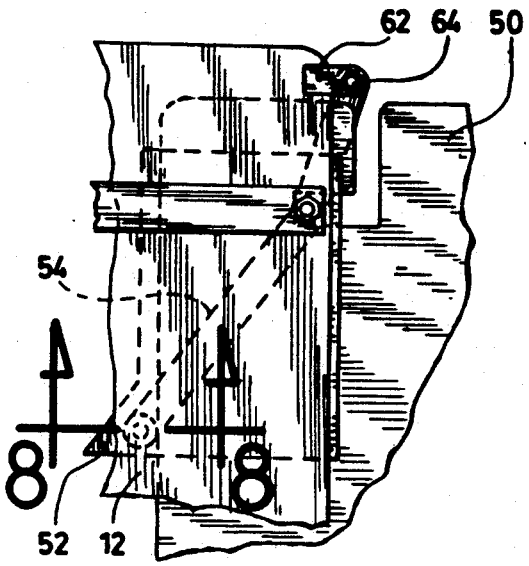
FIG. 7 is a rear view along line 7—7 of FIG. 6*a* of the connecting arrangement between the placard and the signboard.
Figure 8:
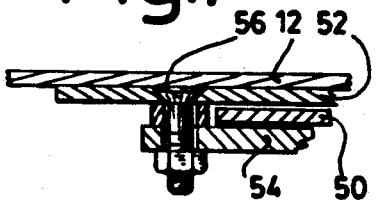
FIG. 8 is cross-sectional view taken along line 8—8 of FIG. 7.

FIGS. 5 and 5*a* illustrate two alternative embodiments wherein the placard 50 is installed to the lower end of the signboard 12 while, in FIG. 5*a* the placard is hooked to the upper part of the signboard. These two latter arrangements make use of a panel or brace 52 and a retaining plate 54 to support the placard 50. The brace 52 is fixed to the signboard 12 by a screw 56 having a tapered head so as to allow the signboard 12 to lie flat on the brace 52. The brace 52 is provided with a lateral flange 58 which is adapted to lie in contact with the lateral left-hand edge of the signboard 12 in order to soldify the panel on the signboard against any rotational force exerted by the installation of the placard. The upper arm of the retaining plate 54 extends upwardly and is adapted to reach the left-hand upper corner of the placard with the knob 60. The knob 60 prevents an unintentional rotation of the placard 50. In order to add additional security for the prevention of the rotation of the placard 50, a friction plate 62 is inserted between the knot 64 and knob 62 so that when the bolt 66 is tightened, the friction plate 62 will be tightened against the placard 50 and will further prevent its unintentional rotation.

Figure 10:
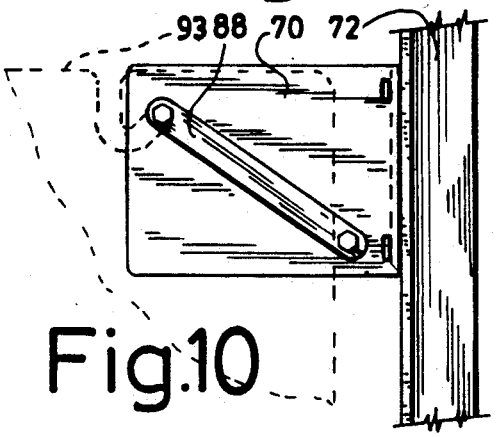
FIGS. 10 and 10*a* are front views of a signboard providing the connecting arrangement contemplated by the present invention.
Figure 10A:
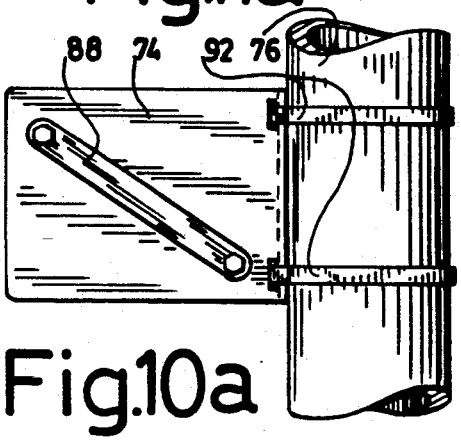
Figure 12:
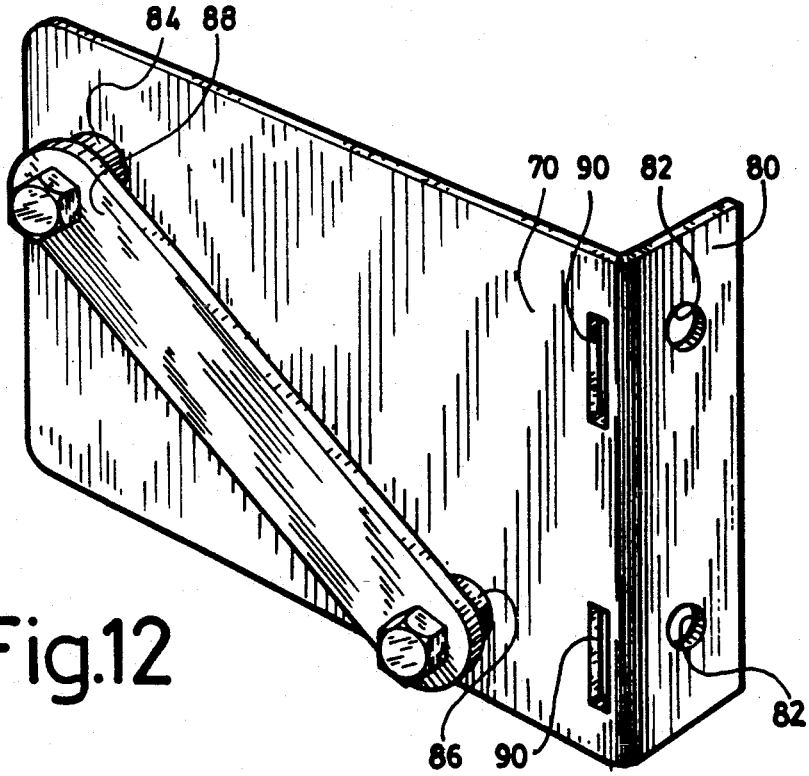
FIG. 12 is a perspective view of a panel incorporating the connecting means for holding the placard.
Figure 13:
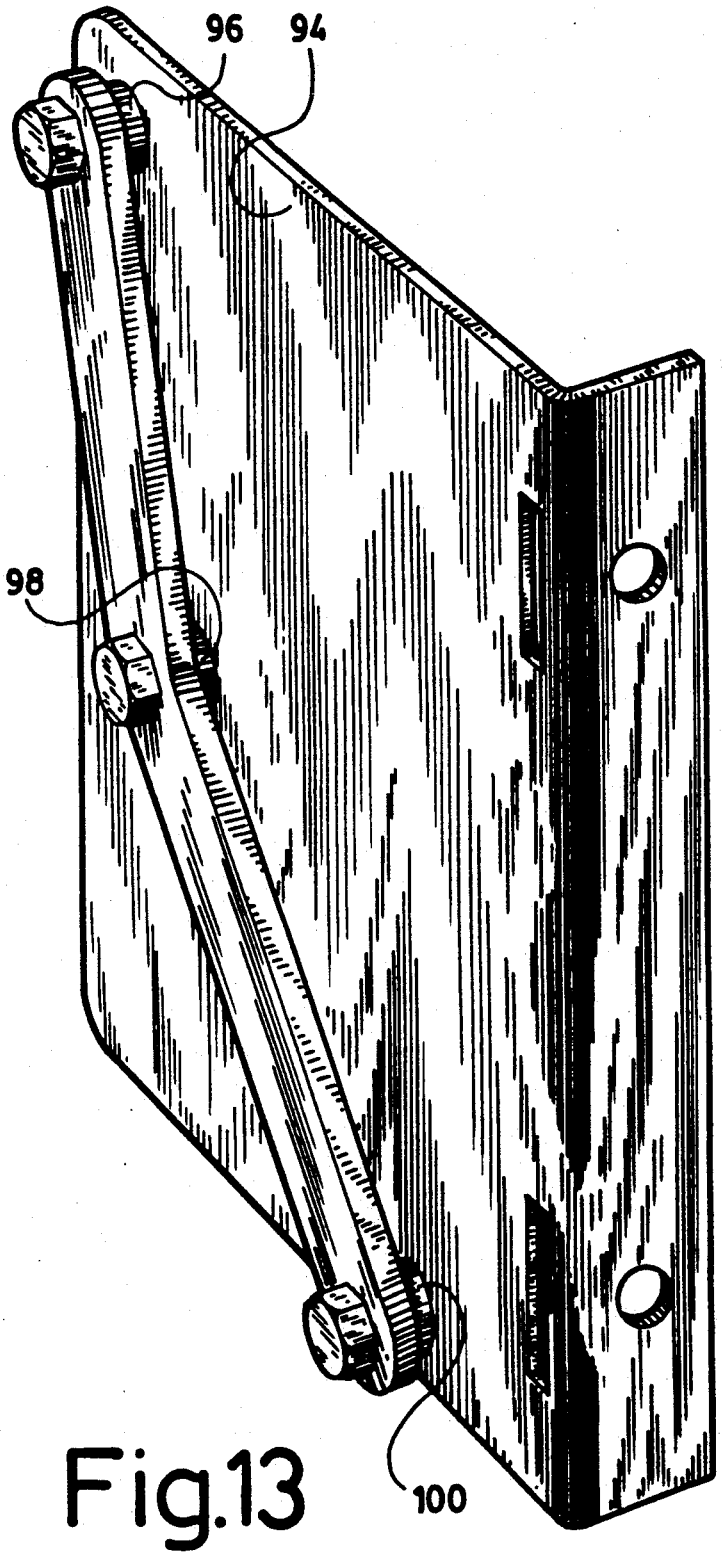
FIG. 13 is a perspective view of an alternative embodiment of FIG. 12.

As illustrated in FIG. 10 and 10*a*, the signboard may be constituted by a plate 70 secured to post 72 or a plate 74 secured to a post 76. Depending on the post on which these plates are installed, the means for securing the latter may vary. For instance, the FIG. 10, plate 70 is secured to flanges of the post 72 by means of bolts 78 extending through a flange 80 of the plate 70, that is, through apertures 82. The plate 70 is provided with a stem 84 and an abutment member 86 interconnected by a retaining plate 88. The same plate 70 such as 74 may be installed on a cylindrical post 76 by providing a pair of slots 90 parallel and adjacent the flange 80. The slots are used to secure the plate 74 to the cylindrical post with steel belts 92. As identified in dotted lines in FIG. 10, the placard 92 is hooked to the plate 70 in the manner described previously, that is, by supporting the placard with the stem 84 and abuting the left-hand edge of the placard 92 on the member 86 to maintain its verticality. The signboard may also be substituted by a plate 94 as shown in FIG. 13 when an embodiment as described in FIGS. 5 and 5*a* is needed. The hooking arrangement to a post is made as described in FIG. 12 and the relative position of the stem 96, the stem 98, the abutment member 100 and the knob 96 are located according to the predetermined position explained in FIGS. 5 and 5*a*.

Figure 14:
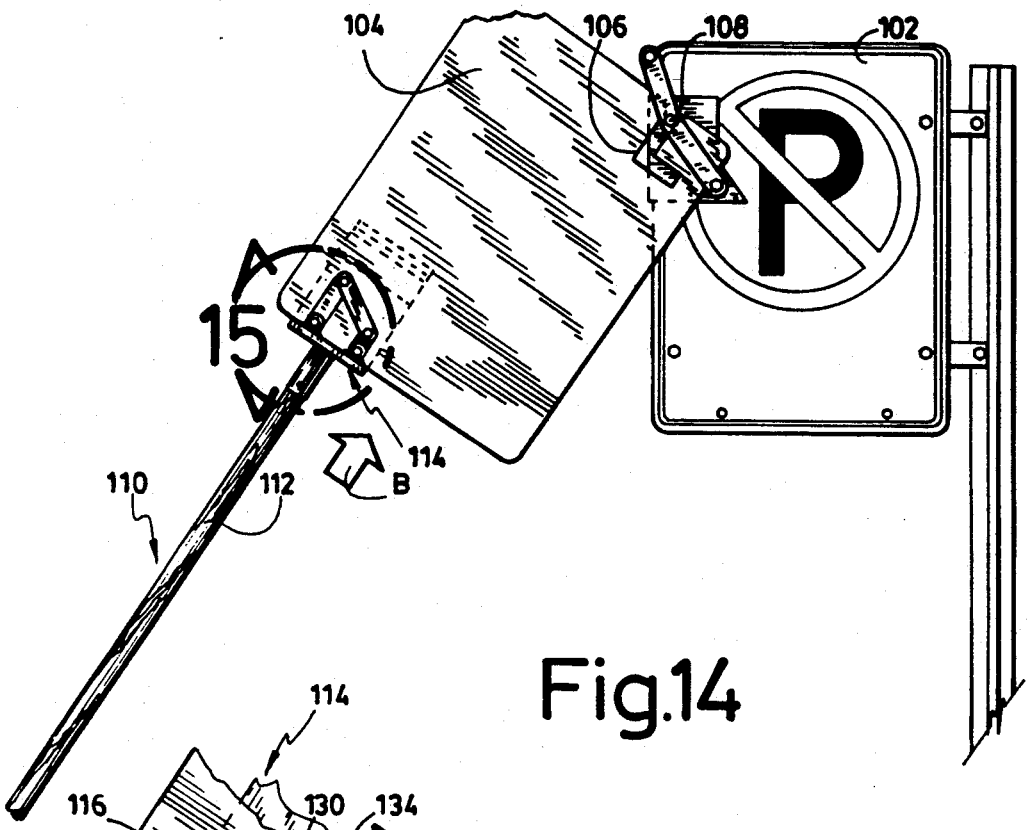
FIG. 14 is a front view of a gripping rod for installing a placard on a signboard.

Considering that signboards such as 102 in FIG. 14 are located at about 7 to 10 feet above the ground, a person installing placards such as 104 in FIG. 14 needs an implement to raise the placard at the desired height to hook the latter to the signboard 102. As shown in FIG. 14, the placard not only needs to be raised, but must be tilted relative to the signboard in order to hook the L-shaped slot 106 in the stem 108. Such implement consists of a gripping rod 110 having a handle 112 to which is secured a gripping plate 114. In order to make use of the gripping rod 110, the placard 104 is provided with marginal slots 116 and 118 as shown in FIG. 5*a*, slot 116 being preferably longer than slot 118.

The gripping plate 14 is made of a relatively rigid sheet 120 having a lower flange 122 connected to the handle 112.

A flexible membrane 124 extends upwardly from the sheet 120 and is slightly tilted towards the side forming the flange 122.

A pair of stems 126 and 128 disposed parallel and adjacent the flange 122 extends in the direction corresponding to the flange 22. A second pair of stems 130 and 132 project from the sheet 120 on the same side as the stems 126 and 128 and are disposed above and at an angle relative to the latter. The two stems 130 and 132 are connected by a rigid strip 134. The relative positions of the stems 126, 128, 130 and 132 is such so as to engage the slots 116 and 118 and the length of the same aforementioned stems is such as to allow the thickness of the placard 104 to slide behind the strip 134 so that the intermediate portion 136 located between the two slots 116 and 118 is hooked by the strip 134.

Figure 15:
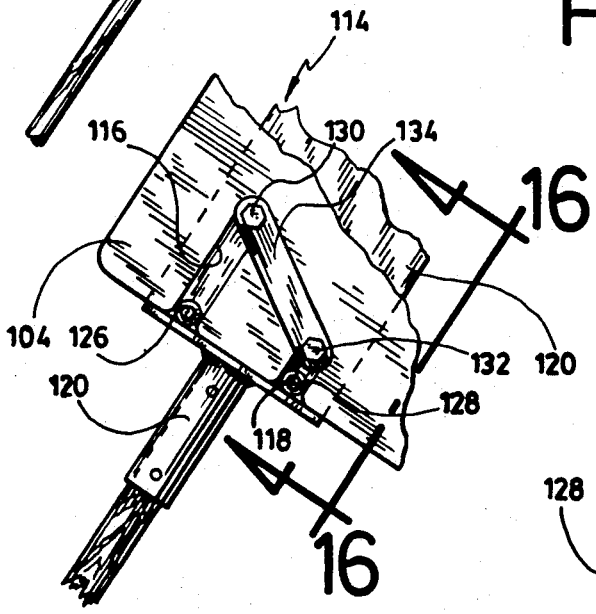
FIG. 15 is an enlarged view of encircled portion 15 shown in FIG. 14.
Figure 16:
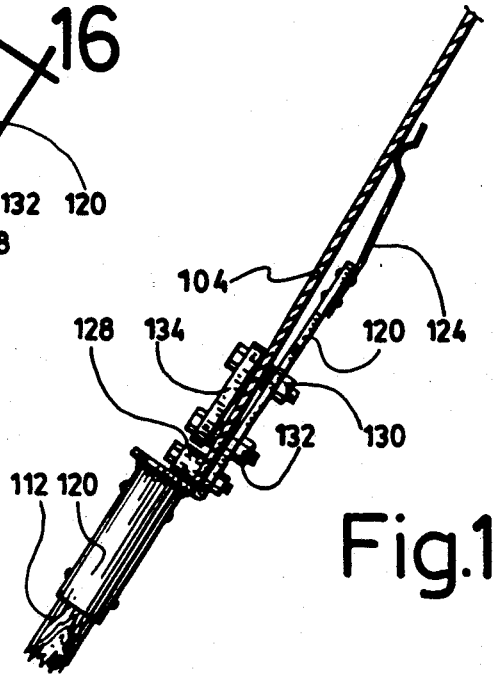
FIG. 16 is a side view taken along line 16—16 of FIG. 15.
Figure 17:
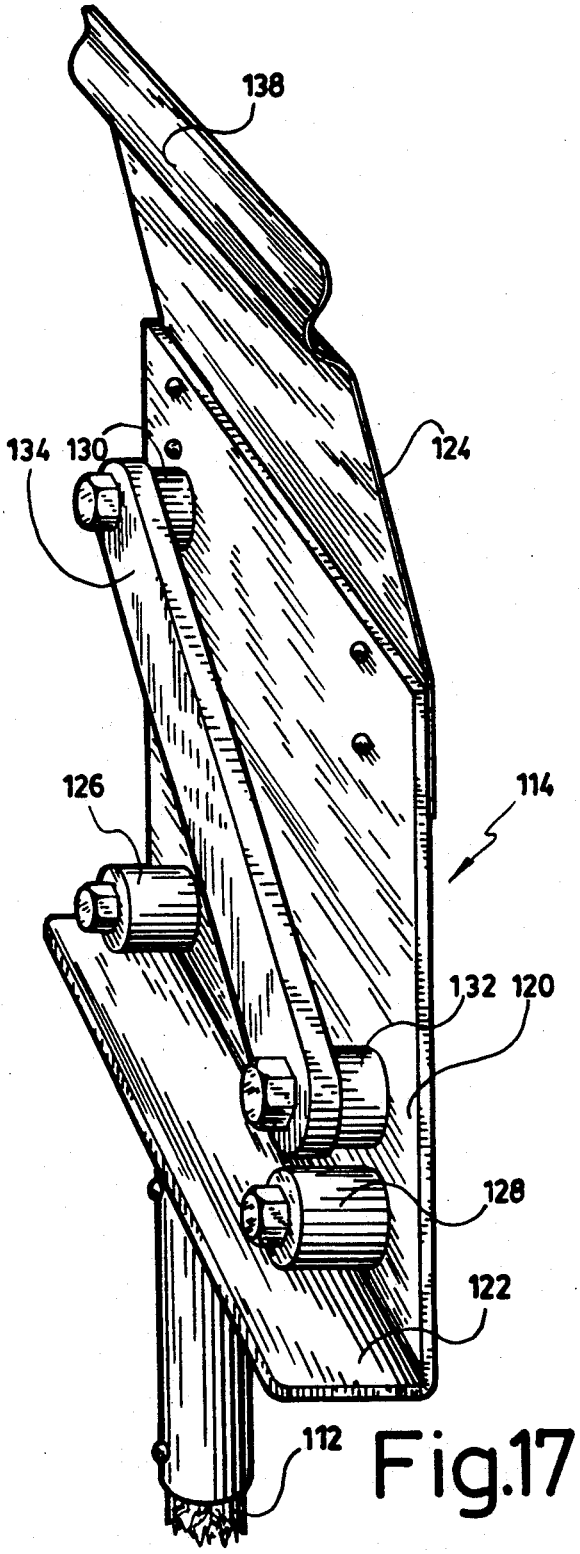
FIG. 17 is a perspective view of a supporting plate mounted on the gripping rod for holding the placard during its installation.
Figure 18:
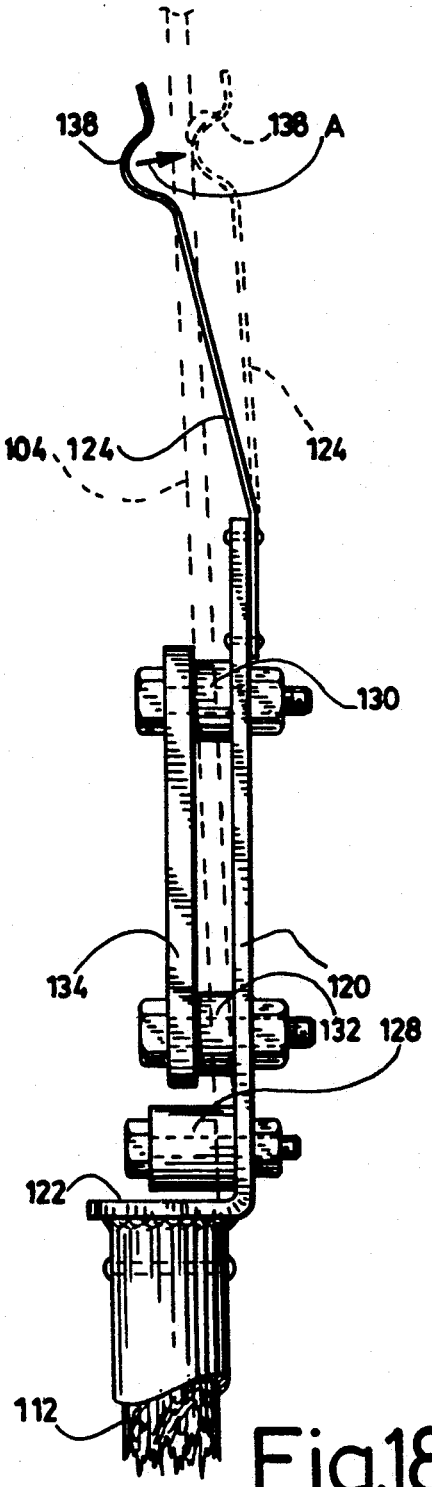
FIG. 18 is a side view of the supporting plate shown in FIG. 17.

In order to install a placard 104 on the signboard 102 as shown in FIG. 14, the gripping rod 110 is hooked onto the placard 104 as shown in FIGS. 14 and 15 so as to be held firmly during all the installation process. The firmness of the placard 104 on the gripping rod 110 is increased by the flexible membrane 124 which, on account of its resilience, abuts against the placard 104 and pries it against the rigid strip 134. The placard 104 has a tendency to push the membrane 124 in the direction of the arrow A as seen in FIG. 18.

As seen in FIG. 14, once the gripping rod 110 is hooked to the placard 104, it is pushed in the direction of the arrow B to engage the slot 106 down to its lower end and after the gripping rod 110 is tilted back to a vertical direction to slide the stem 108 up to the right hand side of the slot 106 as particularly shown in FIG. 14. Once the gripping rod 110 has reached its vertical position, it can be unhooked by releasing the intermediate portion 136 and by pulling on the handle 112.

The two stems 130 and 132 are set at an angle so as to facilitate the installation of the placard from a tilted position such as shown in FIG. 14 to its vertical position.

The flexible membrane 124 is preferably provided with a frontal ridge 138 so as to prevent a greater inclination of the membrane 124 and provide a more localised friction area on the placard 104.

Figure 9:
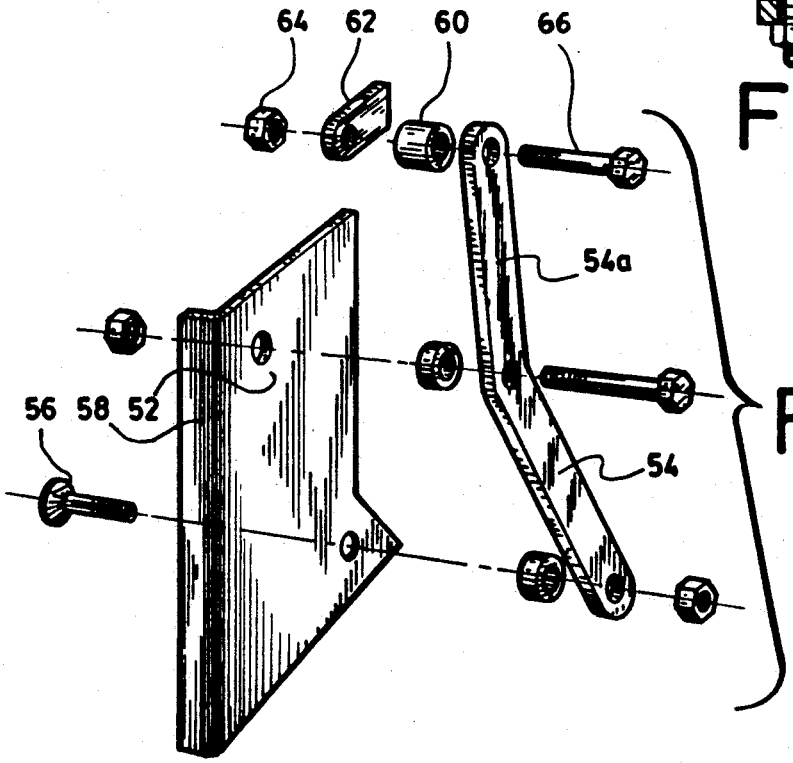
FIG. 9 is an exploded view of some parts of the hardware for connecting the placard to the signboard.
Figure 11:
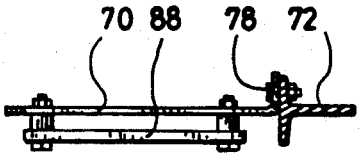
FIGS. 11 and 11*a* are top views of FIGS. 10 and 10*a* respectively.
Figure 11A:
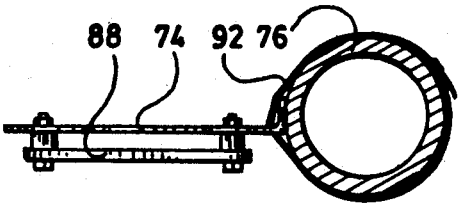

Although the display device described above has referred to the installation of only one placard per signboard, it is within the embodiment of this invention to install a pair of placards on opposite sides of a signboard by duplicating the hardware which is shown in FIG. 9. The two placards can be facing each other by making use of the same holes in the signboard.

The slots 116 and 118 (FIGS. 5 and 5*a*) have been described as having preferably different lengths. However, when the placards are installed on opposite sides of the signboard, the length of these slots are preferably of equal length, that is, of the length of slot 116. The gripping rod 110 is accordingly provided with a strip 134 parallel to the flange 122 at a distance corresponding to the length of the slot 116.

I claim:

1. A display device comprising a placard releasably mounted on and adjacent a fixed support and a connecting member fixed on said support for allowing the hooking of said placard to said support, said connecting member including a stem forwardly projecting from said support adjacent a lateral edge thereof, an abutment member forwardly projecting from said support and located below and more remote from said lateral edge than said stem, said placard having a lateral edge, an upper edge and a generally L-shaped slot extending through said upper edge and adjacent said lateral edge of said placard, said slot having one channel extending downwardly from said upper edge and a second channel extending from said one channel to an area in the direction of the said lateral edge of the placard, the distance between said area and said lateral edge of the placard corresponding to the horizontal distance between said stem and said abutment member, whereby when said L-shaped slot is hooked on said stem at said area, said lateral edge of said placard rests against said abutment member in a substantially vertical direction and on a plane parallel to the support.

2. A display device as recited in claim 1, comprising a retaining plate secured to said stem and to said abutment member for maintaining said retaining plate in a substantially parallel relationship with said support at a distance slightly greater than the thickness of said placard for allowing a portion of said placard adjacent said area to slide between said plate and said support.

3. A display device as recited in claim 2, wherein said stem and said abutment member are mounted on a panel secured to said support, said panel having a lateral flange adapted to abut against said lateral edge of said signboard.

4. A display device as recited in claim 3, wherein said retaining plate comprises a brace extending in a direction substantially corresponding to a longitudinal prolongation of the direction between the stem and the abutment member, said brace having a knob projecting in a direction towards the support, said knob adapted to abut against an upper portion of the placard adjacent said one channel when said placard is hooked on said stem in a vertical position.

5. A display device as recited in claim 4, wherein said placard has a lower edge and is provided with a pair of parallel longitudinal slots extending from the lower edge of said placard and having different lengths, said longitudinal slots adapted to be engaged by a gripping rod for manipulating said placard.

6. A display device as recited in claim 5, wherein said gripping rod comprises a relatively rigid sheet having a lower flange and a tubular handle for supporting said rod, two pairs of stems projecting from said sheet in the same direction as said flange, the second pair of said stems located above said one pair, and at an angle relative to said flange, said second pair adapted to engage said longitudinal slots, a rigid strip connecting both stems of the second pair for supporting a portion of the placard between both longitudinal slots, whereby said placard is adapted to be supported by said strip and said flange and be manipulated by said handle.

7. A display device as recited in claim 6, wherein said sheet has a ridge parallel to said flange and above said two pairs of stems, said ridge protruding from the sheet on a side of the sheet corresponding to the direction of the stems, said ridge adapted to abut against said placard when the latter is manipulated by said gripping rod.

* * * * *